US012653310B2

(12) United States Patent
Petker

(10) Patent No.: US 12,653,310 B2
(45) Date of Patent: Jun. 16, 2026

(54) PULLOUT GUIDE

(71) Applicant: Paul Hettich GmbH & Co. KG, Kirchlengern (DE)

(72) Inventor: Waldemar Petker, Buende (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 404 days.

(21) Appl. No.: 17/640,881

(22) PCT Filed: Sep. 1, 2020

(86) PCT No.: PCT/EP2020/074322
§ 371 (c)(1),
(2) Date: Mar. 7, 2022

(87) PCT Pub. No.: WO2021/047951
PCT Pub. Date: Mar. 18, 2021

(65) Prior Publication Data

US 2022/0330696 A1 Oct. 20, 2022

(30) Foreign Application Priority Data

Sep. 13, 2019 (DE) ..... 10 2019 124 732.2

(51) Int. Cl.
*A47B 88/493* (2017.01)
*A47B 88/437* (2017.01)

(52) U.S. Cl.
CPC ..... *A47B 88/493* (2017.01); *A47B 88/437* (2017.01); *A47B 2210/0008* (2013.01); *A47B 2210/004* (2013.01)

(58) Field of Classification Search
CPC . A47B 88/437; A47B 88/0466; A47B 88/487; A47B 88/14; A47B 88/493;
(Continued)

(56) References Cited

U.S. PATENT DOCUMENTS 1,705,571 A * 3/1929 James ..... A47B 88/493 312/334.18
2,505,592 A * 4/1950 Stone ..... F24C 15/16 384/59

(Continued)

FOREIGN PATENT DOCUMENTS

AT 401714 B 4/1996
AT 514810 A4 4/2015

(Continued)

OTHER PUBLICATIONS

Translation WO2015039149A1, 7 pages, equivalent to AT514810 (cited on IDS) (Year: 2015).*

(Continued)

*Primary Examiner* — Andrew Roersma
(74) *Attorney, Agent, or Firm* — Collard & Roe, P.C.

(57) ABSTRACT

A pullout guide comprises a stationary guide rail which can be fixed to a body, a middle rail which is movably held on the guide rail via first rolling elements arranged in a first rolling element cage, a running rail which is movably held on the middle rail via second rolling elements arranged in a second rolling element cage, and an opening on the middle rail for a support element, which, in a retracted position of the pullout guide, supports the running rail on the guide rail, the support element being mounted on the middle rail such that it can be lowered. In this case, the opening for the support element can be passed over by at least one second rolling element. This allows the support of the running rail to be optimized.

6 Claims, 13 Drawing Sheets

Figure 1:
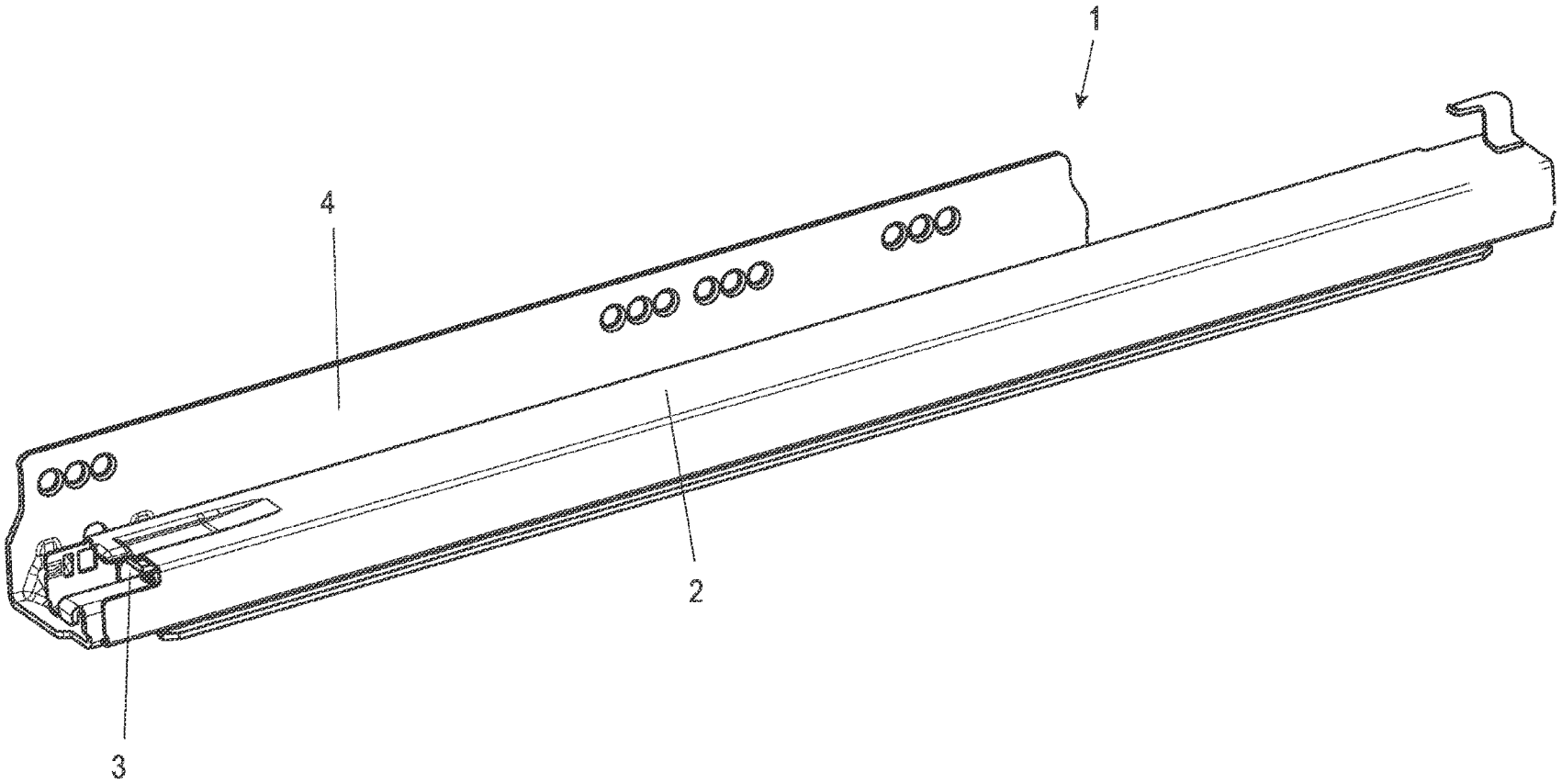

(58) Field of Classification Search
CPC ..... A47B 88/10; A47B 2210/0008; A47B 2210/001; A47B 2210/0037; A47B 2210/004; A47B 2210/0043; A47B 2210/0045
See application file for complete search history.

(56) References Cited

U.S. PATENT DOCUMENTS

| | | | | |
|---|---|---|---|---|
| 5,484,199 | A | 1/1996 | Gasser et al. | |
| 5,882,100 | A * | 3/1999 | Rock | A47B 88/493 312/334.33 |
| 8,167,388 | B2 * | 5/2012 | Hammerle | A47B 88/493 312/334.6 |
| 9,204,722 | B2 | 12/2015 | Violand et al. | |
| 9,642,462 | B2 * | 5/2017 | Violand | A47B 88/493 |
| 10,786,079 | B2 | 9/2020 | Rihtarec et al. | |
| 2016/0081473 | A1 * | 3/2016 | Jiang | A47B 88/473 312/334.33 |
| 2017/0172300 | A1 * | 6/2017 | Bowman | A47B 88/487 |
| 2022/0295987 | A1 * | 9/2022 | Wei | A47B 88/493 |

FOREIGN PATENT DOCUMENTS

| | | | | |
|---|---|---|---|---|
| DE | 102017128748 | A1 | 6/2019 | |
| EP | 2916688 | A1 | 9/2015 | |
| WO | WO-2015086483 | A1 * | 6/2015 | A47B 88/493 |

OTHER PUBLICATIONS

International Search Report dated Oct. 2, 2020 issued in PCT/EP2020/074322 (with English translation).
German Search Report dated May 12, 2020 issued in the corresponding German Application DE 10 2019 124 732.2 (with English translation of relevant parts).

* cited by examiner

PULLOUT GUIDE

CROSS REFERENCE TO RELATED APPLICATIONS

This application is the National Stage of PCT/EP2020/074322 filed on Sep. 1, 2020, which claims priority under 35 U.S.C. § 119 of German Application No. 10 2019 124 732.2 filed on Sep. 13, 2019, the disclosures of which are incorporated by reference. The international application under PCT article 21(2) was not published in English.

BACKGROUND OF THE INVENTION

The present invention relates to a pullout guide comprising a stationary guide rail, which can be fixed to a body, a middle rail, which is held movably on the guide rail via first rolling elements, which are arranged in a first rolling element cage, a running rail, which is held movably on the middle rail via second rolling elements, which are arranged in a second rolling element cage, and an opening, provided on the middle rail for a supporting element, which, in a retracted position of the pullout guide, supports the running rail on the guide rail, where the supporting element is mounted on the middle rail such that it can be lowered.

EP 2 916 688 B1 discloses a drawer pullout guide in which a body rail, a drawer rail and a middle rail are provided between the body rail and the drawer rail. For supporting the drawer rail, a support roller is provided which is arranged between a horizontal web of the body rail and an elevation of the drawer rail. The support roller can thus transmit forces from the drawer rail to the body rail. However, there is the disadvantage that the support roller projects upwards from the middle rail, so that in the maximum extended position of the pullout guide, the rolling elements can only be moved as far as the support roller, thus limiting the length of the track for the rolling elements. As a result, the maximum support width, i.e. the distance between the foremost rolling element and the rearmost rolling element, becomes smaller, which leads to a reduction in the guide quality. In addition, jamming can occur at the support roller.

SUMMARY OF THE INVENTION

It is therefore an objection of the present invention to provide a pullout guide with an improved guide for the running rail.

This task is solved with a pullout guide having the features of claim 1.

In the pullout guide according to the invention, the support element, arranged on the middle rail between the guide rail and the running rail, is movably mounted, an opening is provided on the middle rail for the support element, which, in a retracted position of the pullout guide, supports the running rail on the guide rail, and the support element is mounted on the middle rail such that it can be lowered, where at least one second rolling element can pass over the opening for the support element. In this way the support element can serve to support the running rail on the guide rail in the retracted position and can be lowered when it is being extended, to be able to use the installation space above the support element. Lowering in the "vertical direction" does not have to be carried out exactly vertically in the installation position of the pullout guide, but can also be carried out at an angle to the vertical direction such that at least a vertical portion of a translational movement is present when the support element is moved.

Preferably, the support element is movable from a raised position in the retracted position of the pullout guide to a lowered position in an extended position of the pullout guide. Thereby, in the raised position, the support element may extend through an opening in the middle rail, and in the lowered position, an upper surface of the support element does not protrude beyond an upper track on the middle rail. Thus, in the lowered position, the upper surface of the support element may optionally be positioned at the same height as the track or may be lowered below the height of the track. This makes it possible to extend the upper track for the rolling elements, because they no longer abut against the support element, as the support element can be run over fully or partially in the lowered position.

To ensure that the movement of the support element is not abrupt when the pullout guide is extended and retracted, the guide rail preferably has an approach slope for raising or lowering of the support element. The approach slope can be linear or arc-shaped, whereby the approach slope is preferably formed by an integrally formed bend or a web on the guide rail.

In a further embodiment, a bearing block is fixed to the middle rail and supports the support element so that it can be moved in the vertical direction. The bearing block can have two elongated holes or slot-shaped receptacles in which pins projecting laterally from the support element engage, so that the two pins are each guided in a slot or receptacle in order to support the support element in a displaceable or movable manner. Such a movable mounting also prevents jamming of the support element. The support element can also be mounted in the bearing block without pins. In this case, the upper and lower openings on the bearing block can be somewhat smaller than the diameter of a support roller or the width of a plunger as a support element so that it cannot fall out in the vertical direction. Other guide elements can also be provided on the bearing block to guide the support element, for example guide webs. The bearing block can be fixed to the middle rail in a clamping or latching manner and can thus be easily mounted. The bearing block could also be formed from the material of the middle rail.

The support element is preferably designed as a rotatably mounted support roller. In this case, the support roller can optionally be rotatably and displaceably held on the bearing block so that it can be moved between the raised and lowered positions. In an alternative embodiment, the support element is designed as a displaceable plunger that can be moved along the guide rail and the running rail with sliding surfaces in order to be raised and lowered.

The middle rail preferably forms an upper track for the second rolling elements, which is preferably formed on a horizontally aligned web, wherein the second rolling elements can be moved at least partially over an opening through which the support roller passes in the raised position. When the support roller is lowered in the extended position of the pullout guide, the rolling elements can be moved at least partially, preferably also completely, over the opening on the middle rail. The second rolling elements are thereby preferably formed longer in a horizontal direction perpendicular to the longitudinal direction of the middle rail than the opening for the support roller, so that in the region of the opening the rolling elements are supported in the region adjacent to the opening. Optionally, part of the rolling elements can also be moved beyond one end face of the middle rail, to increase the maximum support width of the pullout guide.

The running rail preferably has a downwardly projecting embossment which rests on the support roller in the retracted position. The embossing can be in the form of a strip in the longitudinal direction of the running rail and includes an approach slope to ensure a smooth running of the running rail onto the support roller.

In the following, the invention is explained in more detail, by means of an example of an embodiment with reference to the accompanying drawings, which show:

BRIEF DESCRIPTION OF THE DRAWING FIGURES

Figure 2:
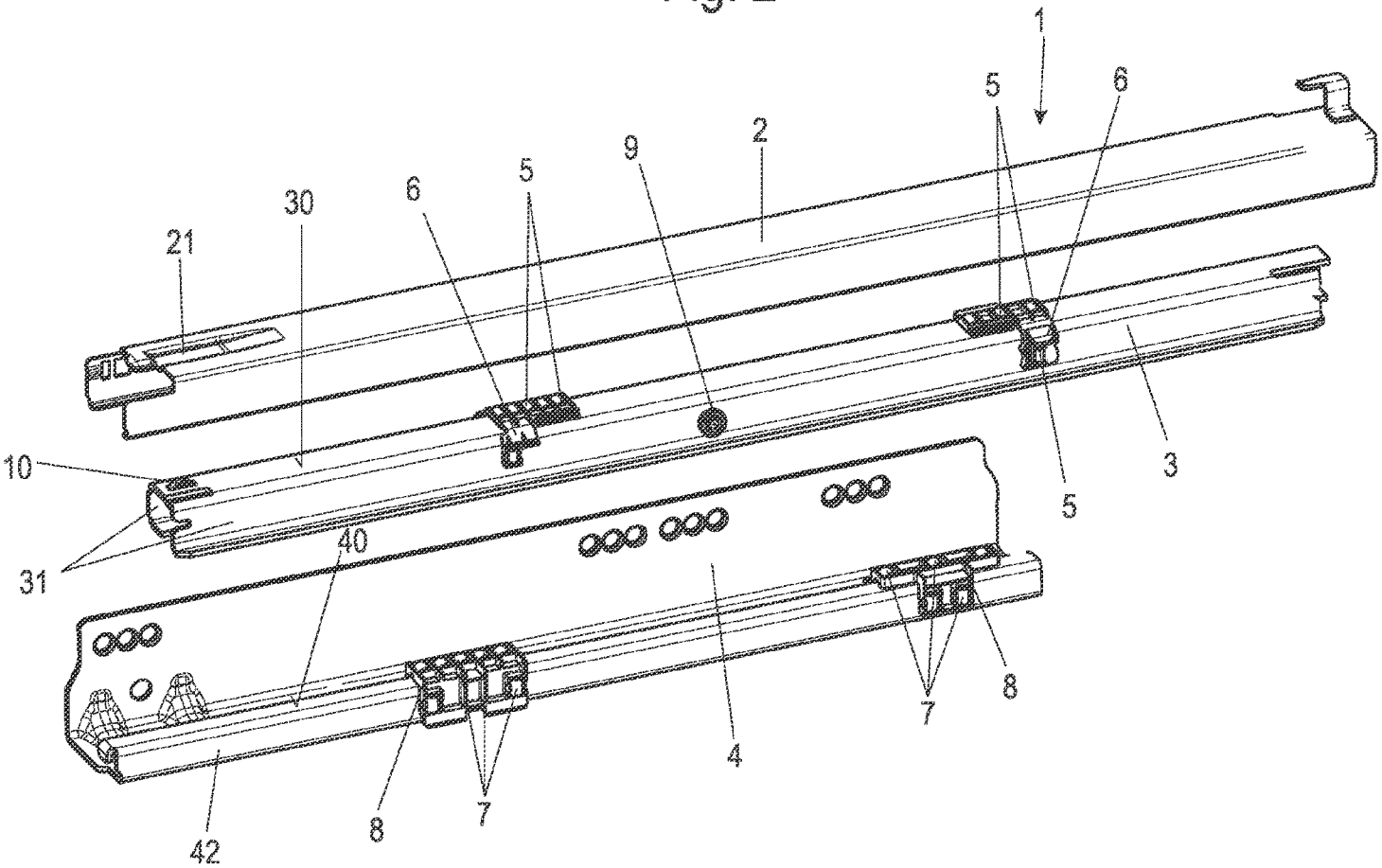
Figure 3:
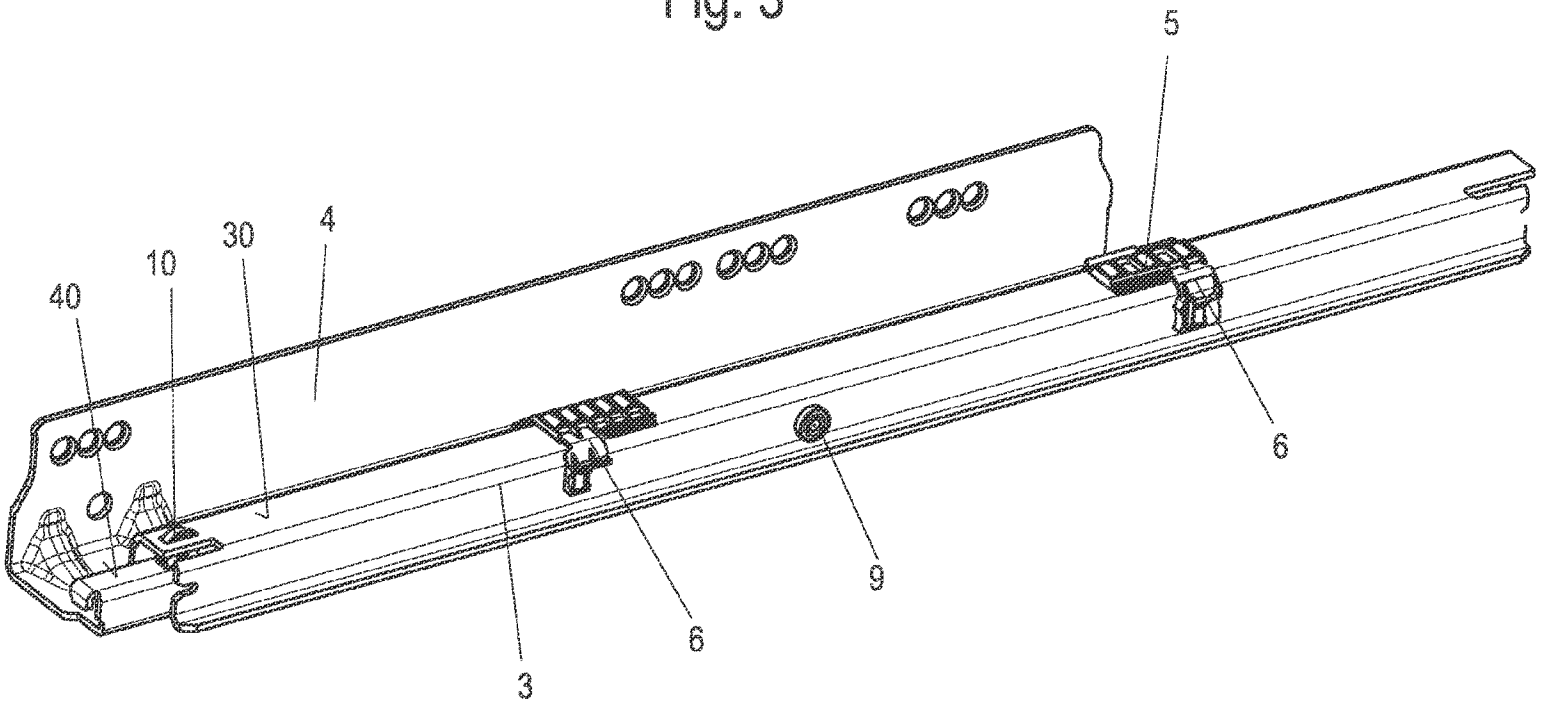
Figure 4:
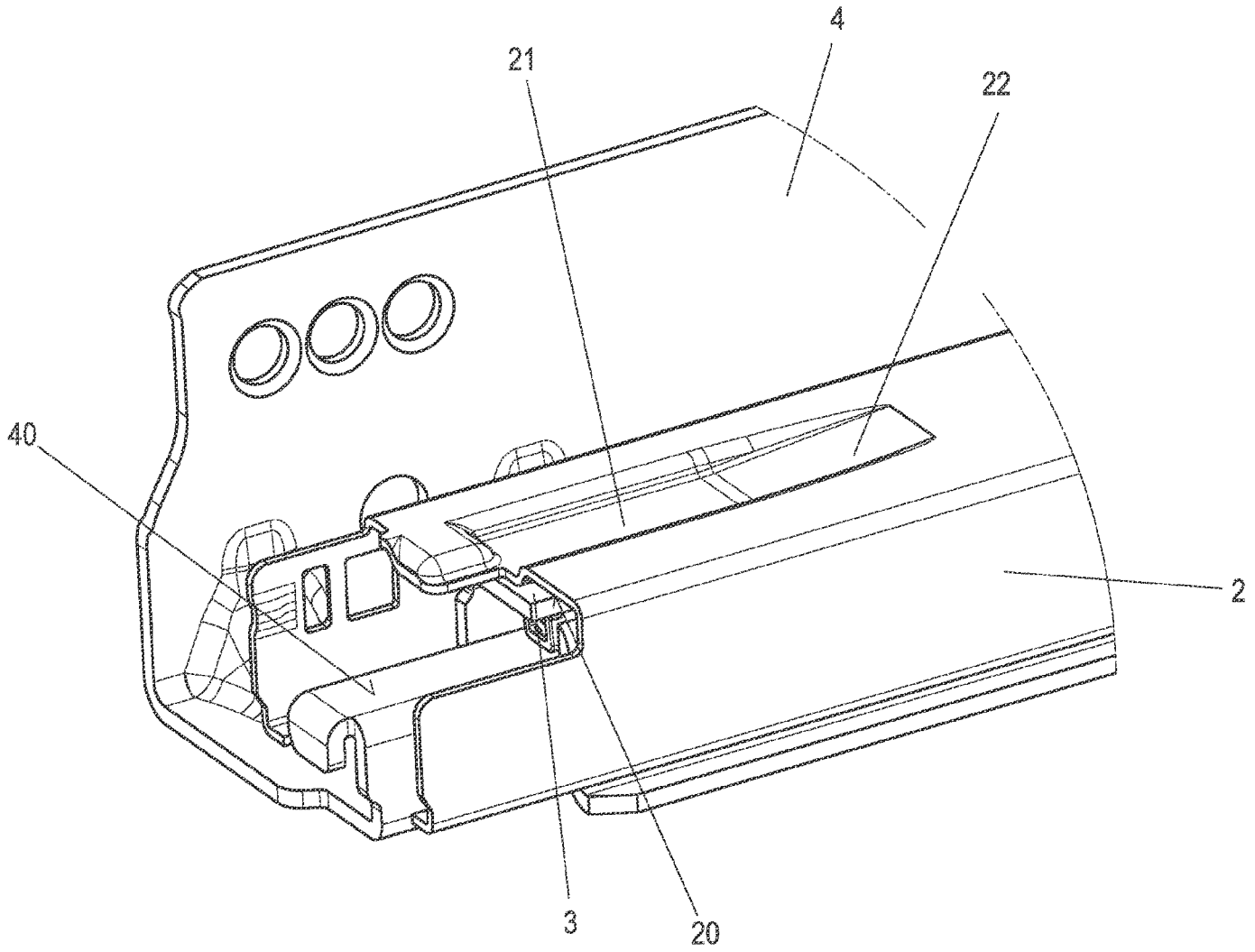
Figure 5:
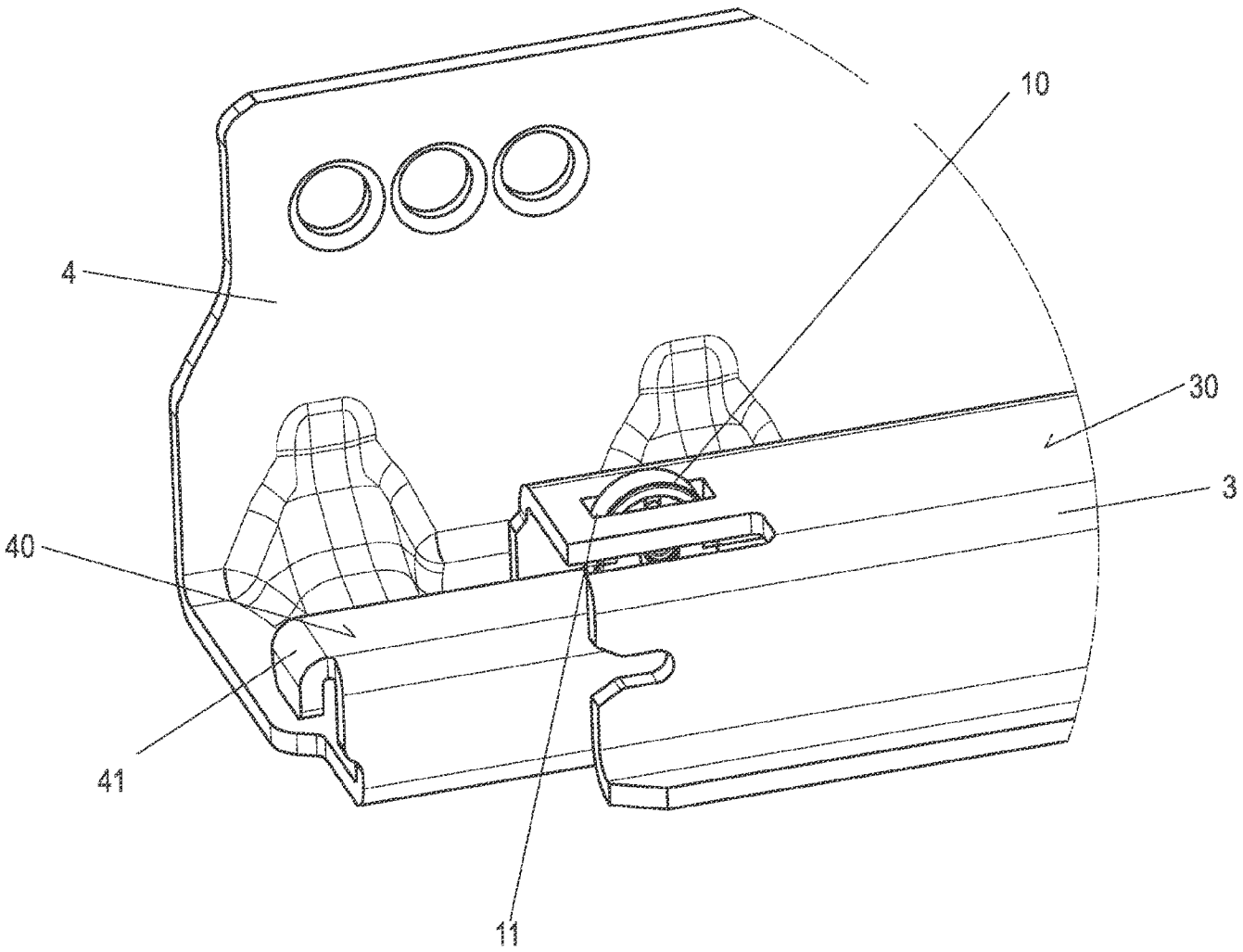
Figure 6:
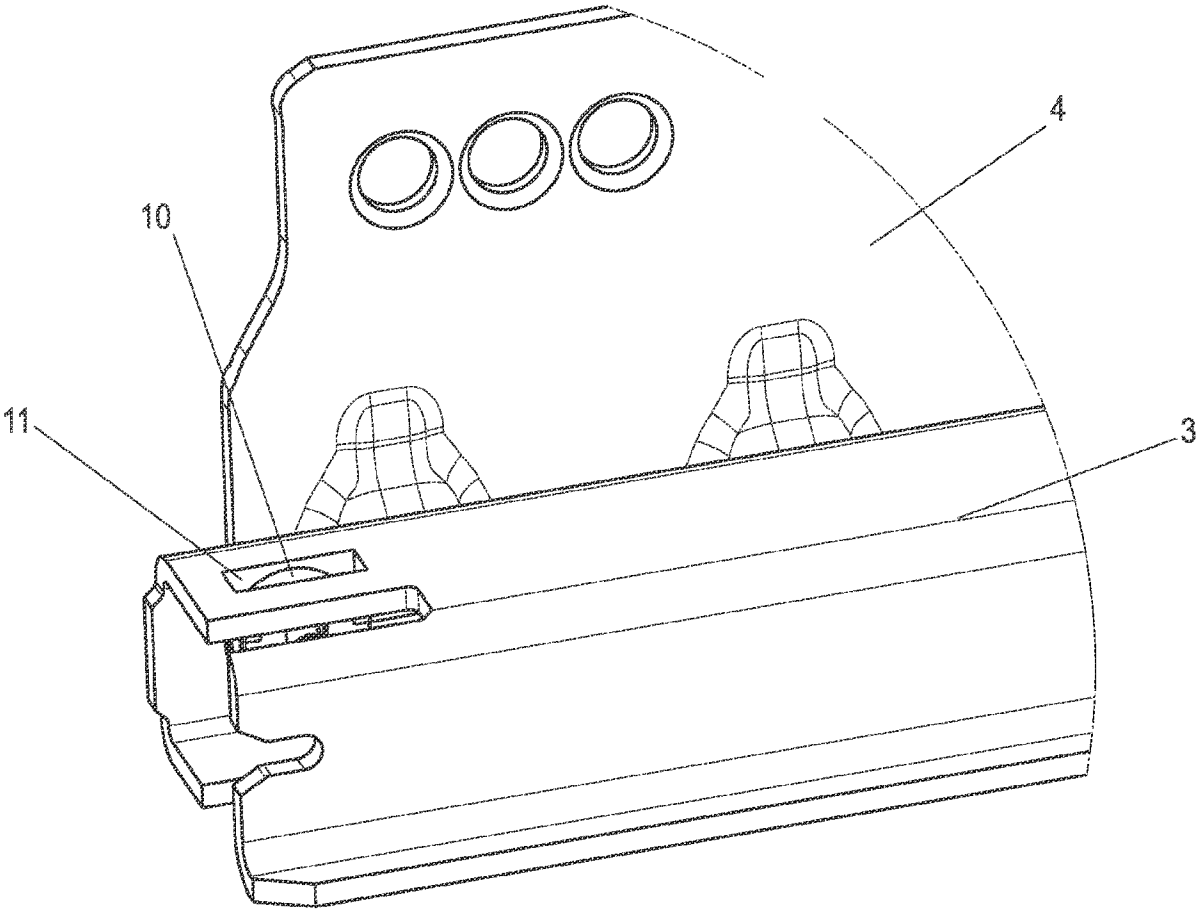
Figure 7A:
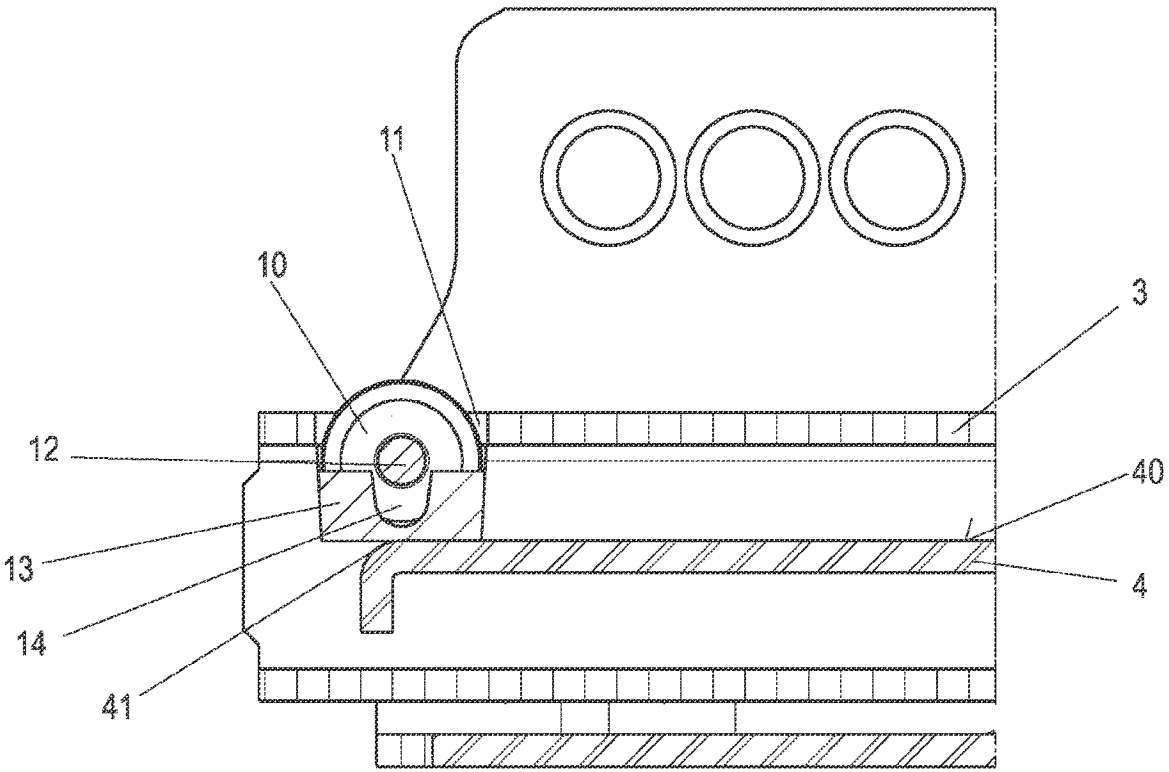
Figure 7B:
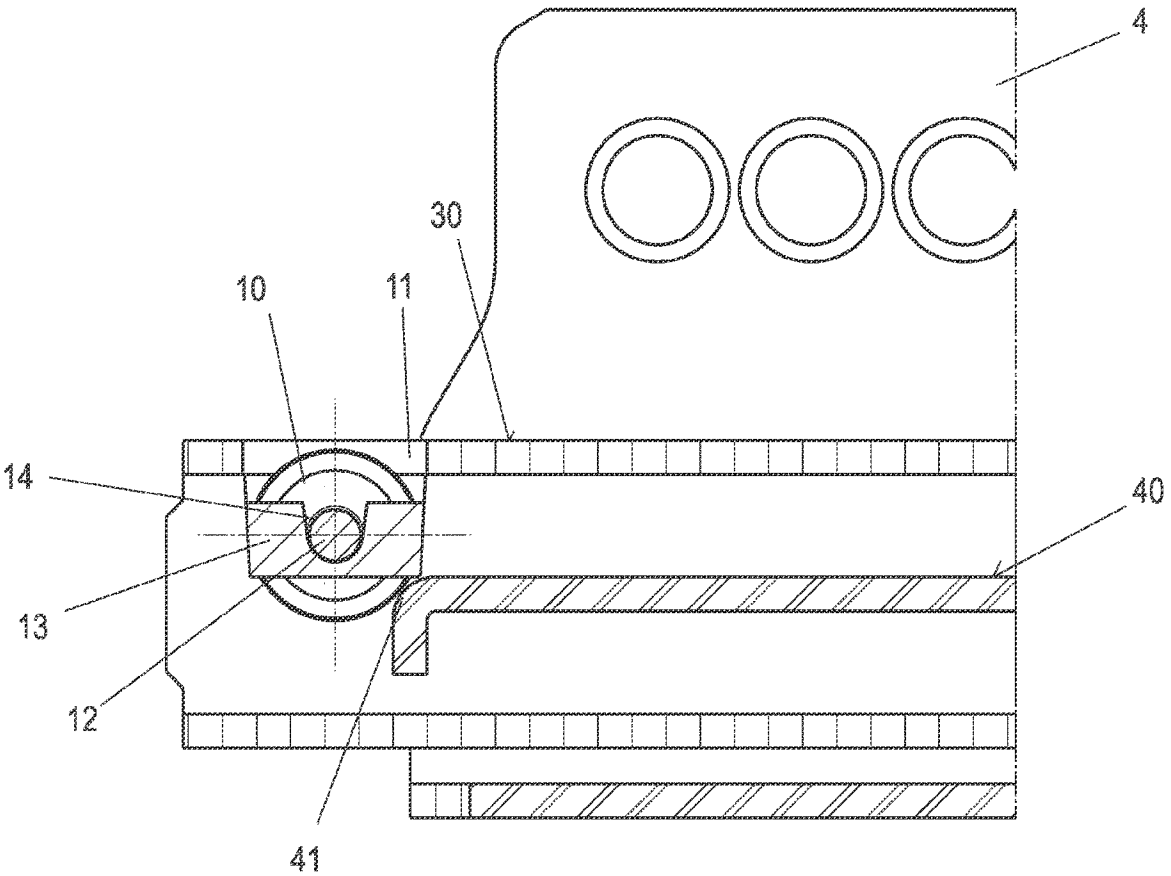
Figure 8A:
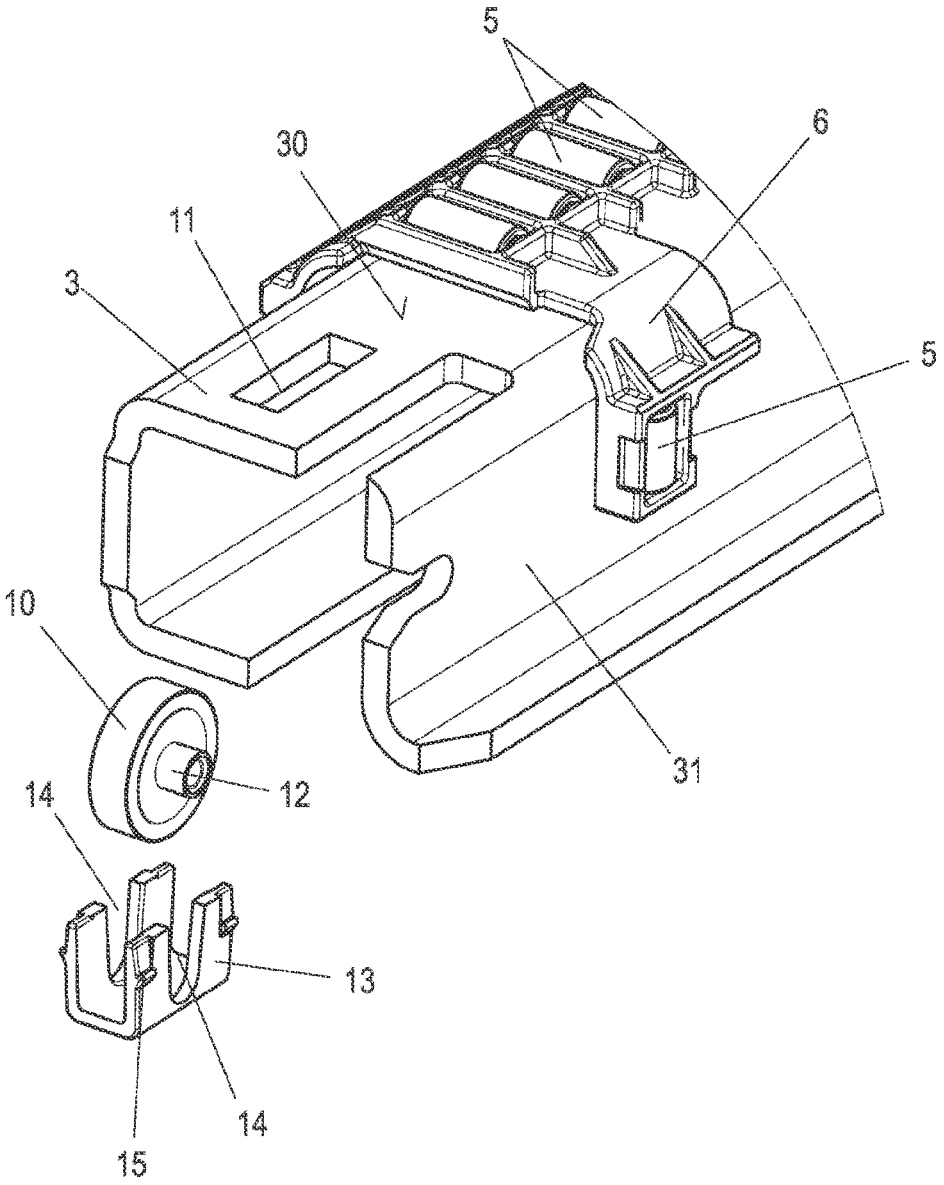
Figure 8B:
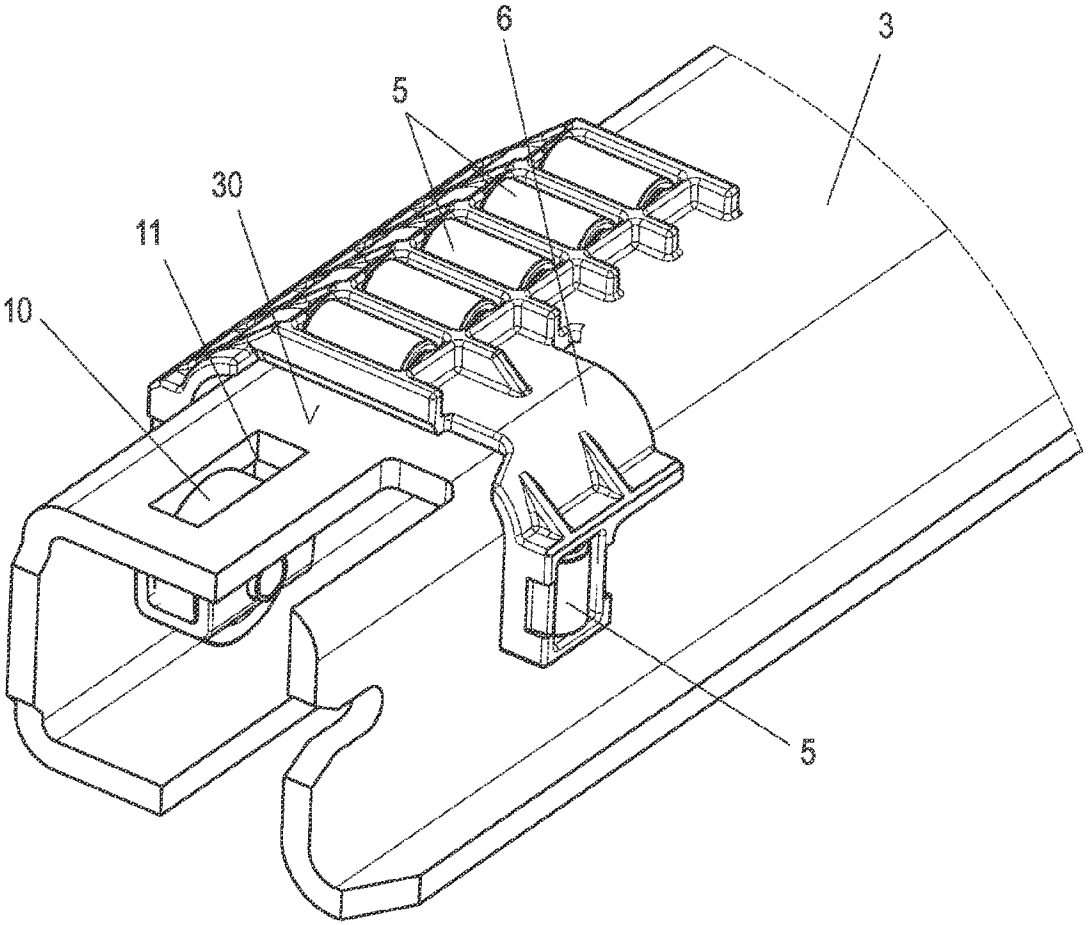
Figure 9:
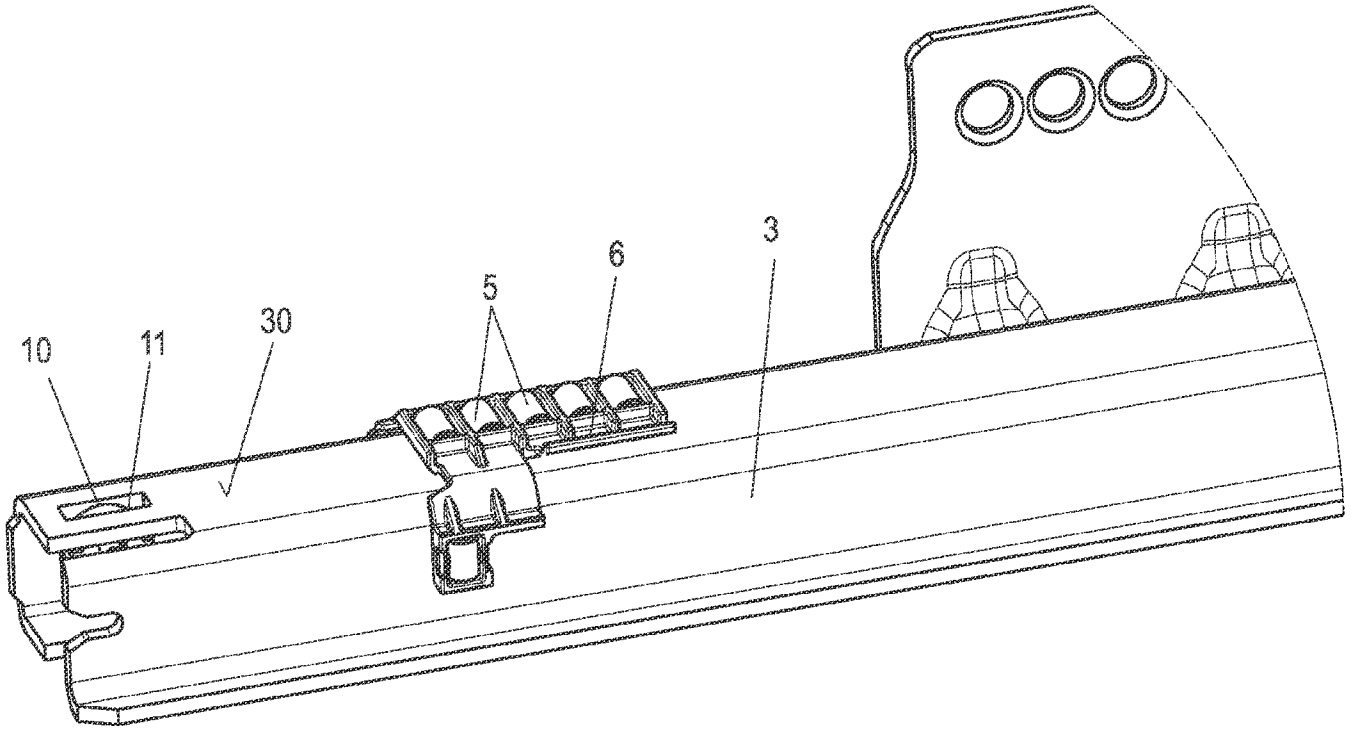
Figure 10:
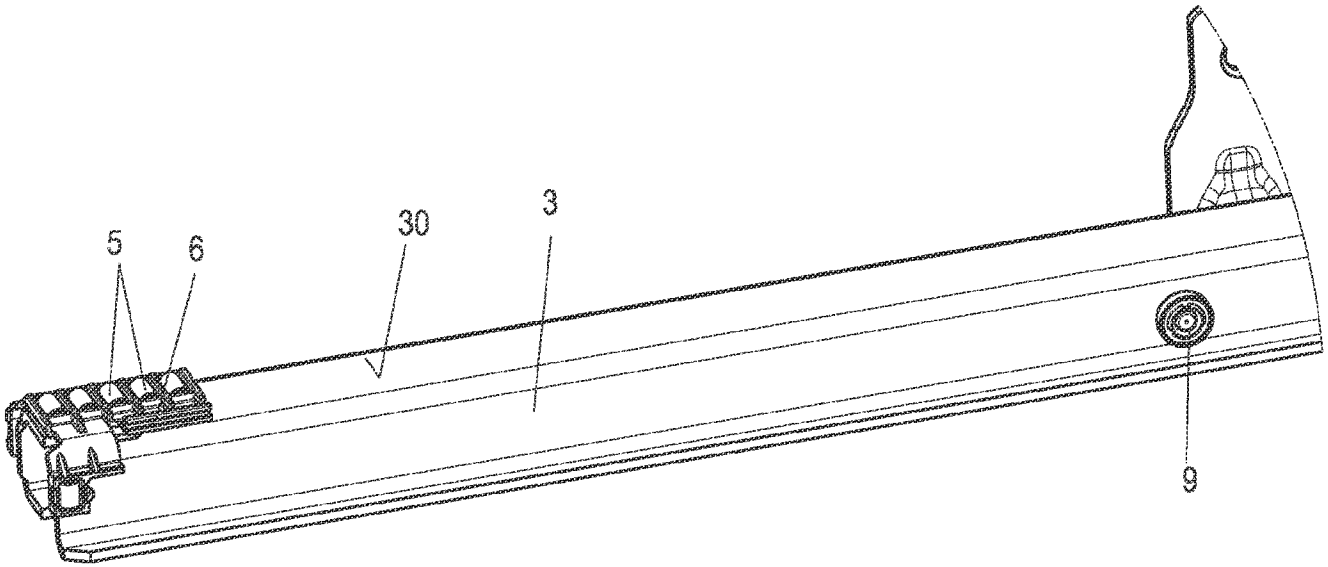
Figure 11:
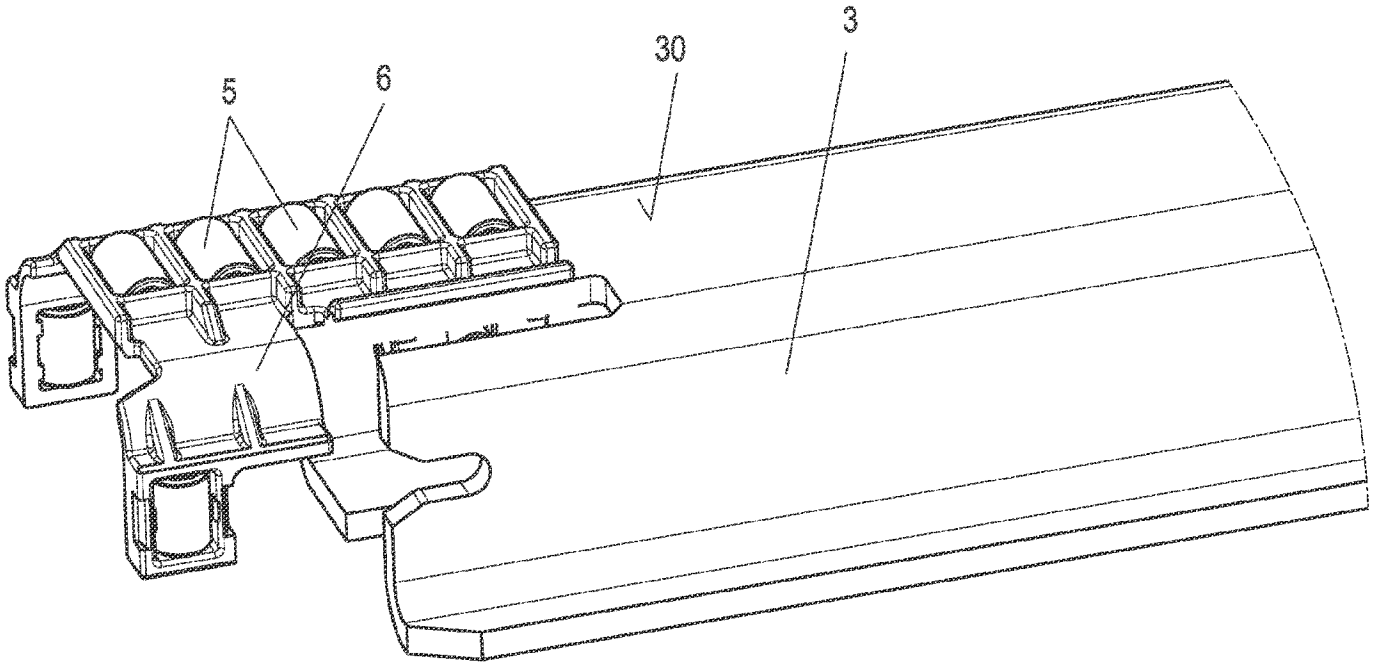

FIG. 1 a perspective view of a pullout guide according to the invention;

FIG. 2 a perspective exploded view of the pullout guide in FIG. 1;

FIG. 3 a perspective view of the pullout guide in FIG. 1 without the running rail;

FIGS. 4 and 5 two detailed views of the pullout guide in FIGS. 1 and 2 in the area of the support roller;

FIG. 6 a detailed view of the pullout guide without running rail with lowered support roller;

FIGS. 7A and 7B two sectional views of the pullout guide in the area of the support roller in different positions;

FIGS. 8A and 8B an exploded view and a view of the middle rail and a rolling element cage in an extended position of the pullout guide, and FIGS. 9 through 11 multiple views of the middle rail of the pullout guide in FIG. 1 during the moving of the front rolling element cage over the opening with the support roller.

DETAILED DESCRIPTION OF THE INVENTION

A pullout guide 1 comprises a stationary guide rail 4, which can be fixed to a body of a piece of furniture or a household appliance, and on which a middle rail 3 can be moved. A running rail 2 is held movably on the middle rail 3.

As can be seen in FIG. 2, the guide rail 4 has an upper track 40 on a horizontal web for first rolling elements 7, which are held in a rolling element cage 8. The rolling elements 7 are designed as cylinders in the illustrated embodiment example, but can also have another shape, such as balls or barrels or crowned rollers. In this case, two spaced-apart rolling element cages 8 are provided, on each of which rolling elements 7 are held. The rolling elements 7 roll not only on the upper track 40, but also on a vertical web 42 and on an underside of the horizontal web with the track 40.

Second rolling elements 5 are movable on the middle rail 3, each of which is held on a rolling element cage 6. Two spaced-apart rolling element cages 6 are also provided, with the foremost rolling element 5 of the front rolling element cage 6 and the rearmost rolling element 5 of the rear rolling element cage 6 defining the maximum support span. The rolling elements 5 at least partially run along an upper track 30 formed on an upper surface of a horizontal web of the middle rail 3. The middle rail 3 further comprises two lateral webs 31 on which further rolling elements 5 roll to provide lateral guidance. The running rail 2 is supported on the rolling elements 5, which roll on the upper track 30.

Optionally, the rolling elements 5 and 7 can all be of identical design. However, it is also possible to design individual rolling elements 5 and 7 differently with regard to the material used or the geometry.

In the installation position, weight forces from an upper web of the running rail 2 act on the rolling elements 5, which roll on the upper track 30 and thus take over the forces in the vertical direction. The term "vertical" here refers to the usual installation situation of the pullout guide 1 in which the weight forces are transferred via the rolling elements 5 on the track 30 and via the rolling elements 7 on the track 40, although the pullout guide 1 can also be mounted in other positions.

At the front end of the middle rail 3 there is a support element in the form of a support roller 10, which in the retracted position of the pullout guide 1 provides support for the running rail 2 on the guide rail 4. Furthermore, at least one fixedly positioned running roller 9 is rotatably mounted on the middle rail 3 and serves to support the running rail 2. The at least one track roller is located between the front and rear rolling element cages 6. The rolling element cages 6 and 8 can optionally be connected to each other via synchronization means. The synchronizing means can be designed as a rope control or as a transmission control with rack and pinion.

FIG. 3 shows the retracted position of the pullout guide 1 without the running rail 2. It can be seen that the support roller 10 engages through the horizontal web with the track 30 on the middle rail 3 and protrudes slightly so that the running rail 2 is supported on the support roller 10 in the area of an embossing 21. In the retracted position the support roller 10 is supported on the horizontal web with the track 40, so that weight forces can be transferred in the front region via the support roller 10. In addition, weight forces can be transferred from the running rail 2 via the rolling elements 5 on the two rolling element cages 6, which are arranged at a distance from the support roller 10.

In FIG. 4, the front section of the pullout guide 1 is shown in a retracted position. It can be seen that a strip-shaped, downwardly formed embossing 21 is arranged above one end of the middle rail 3 and is supported on the not shown support roller 10, which in turn is supported on its underside on the track 40 of the guide rail 4. The embossing 21 is integrally formed with the running rail 2 and projects downwardly from a track 20 at a horizontal upper web of the running rail 2. An approach slope 22 is formed at one end of the embossing 21, which is inclined with respect to the horizontal and allows it to run up onto the support roller 10.

In FIG. 5, the end section of the pullout guide is shown in the retracted position without the running rail 2. It can be seen that the support roller 10 passes through a slot-shaped opening 11 on the middle rail 3, the opening 11 being formed in extension of the track 30. Furthermore, an end section of the track 40 is shown on the guide rail 4, which has an angled web that forms an approach slope 41 for the support roller 10.

In FIG. 6, the support roller 10 is shown in a lowered position compared to FIG. 5, in which an upper circumference of the support roller 10 does not protrude beyond the middle rail 3.

In FIG. 7A, the pullout guide 1 is shown in section in the area of the support roller 10. The support roller 10 rolls on the running surface 40 of the guide rail 4 and is arranged in the raised position. The support roller 10 has protruding pins 12 on opposite sides, which are arranged lowerably in a slot 14 that is open at the top or in a receptacle, whereby the slots 14 are formed on a bearing block 13, which is fixed to the middle rail 3. Through this the support roller 10 is allowed to move lowerably and is guided with play in the slot 14.

As the comparison of FIGS. 7A and 7B shows, during the extension movement of the pullout guide, the support roller 10 is moved along the track 40 until the support roller 10 reaches the bent web with the approach slope 41. Because of gravity, the support roller 10 is then moved from the raised position to the lowered position so that the pins 12 are moved downward within the slot 14. In the lowered position, an upper circumference of the support roller 10 is below the track 30 on the middle rail 3.

In FIG. 8A, the middle rail is shown at the front-end portion with the support roller 10 and a rolling element cage 6. The middle rail 3, which is mainly bent in a U-shape from a steel plate, comprises a rectangular opening 11 in which the support roller 10 is arranged. A bearing block 13 is fixed to the opening 11, which is mounted on the opening 11 in a clamping or latching manner via webs 15, to support the support roller 10 so that it can move in the vertical direction. The webs 15 can serve as an insertion limit in the case of a clamping fixation, so that the bearing block does not engage in the upper track. The laterally projecting pins 12 are insertable into the two slots 14 or receptacles on the bearing block 13.

As shown in FIG. 8B, the cylindrical rolling elements 5 can be moved on the upper track 30 of the middle rail 3 up to the support roller 10. The rolling elements 5 are formed longer than the opening 11 in a horizontal direction perpendicular to the longitudinal direction of the middle rail 3. For example, the rolling elements can be at least twice as long. The opening 11 is rectangular in shape, and its longitudinal direction is aligned approximately parallel to the longitudinal direction of the middle rail 3.

The opening 11 in the middle rail 3 with the bearing block 13 and the rotatable and lowerable support roller 10 together form a bearing point for the support arrangement.

In FIG. 9, the middle rail 3 is shown together with the front rolling element cage 6, whereby the rolling elements 5 are moved along the upper track 30 of the middle rail 3. The support roller 10 is already in the lowered position and does not protrude above the track 30. This allows the rolling elements 5 to be moved in the area of the opening 11, as shown in FIG. 10. In FIG. 10, the foremost rolling element 5 has reached a front end of the track 30. Weight forces can thus be transmitted from the foremost rolling element 5 to the track 30. The opening 11 is completely covered by the rolling elements 5 and the rolling element cage 6.

Optionally, it is possible to move the rolling element cage 6 in the maximum extended position of the running rail 2 even further in the direction of extension, as shown in FIG. 11. Then the foremost rolling element 5 no longer rests on the track 30, but protrudes freely. The weight forces of the running rail 2 are then transmitted to the track 30 via another rolling element 5. This measure allows the maximum support distance between the foremost rolling element on the front rolling element cage and the rearmost rolling element 5 on the rear rolling element 5 to be increased somewhat.

In the embodiment shown, the middle rail 3 is bent in a mainly U-shaped manner. It is of course also possible to manufacture the pullout guide 1 from rails that have a different cross-sectional geometry.

The approach slope 22 on the embossing 21 and the approach slope 41 on the guide rail 4 are oriented inclined to the horizontal in the installed position and can be modified in terms of length and pitch angle.

Instead of the support roller 10, in an alternative embodiment the support element can also be designed as a displaceable plunger, which can be moved along the guide rail and the running rail with sliding surfaces in order to be raised and lowered.

LIST OF REFERENCE SIGNS

1 Pullout guide
2 Running rail
3 Middle rail
4 Guide rail
5 Rolling elements
6 Rolling element cage
7 Rolling elements
8 Rolling element cage
9 Roller
10 Support roller
11 Opening
12 Pin
13 Bearing block
14 Slot
15 Web
20 Track
21 Embossing
22 Approach slope
30 Track
31 Web
40 Track
41 Approach slope
42 Vertical web

What is claimed is:

1. A pullout guide (1), comprising:

a) a stationary guide rail (4) that is configured to be fixed to a body;

b) a middle rail (3) that is movably held on the guide rail (4) by means of first rolling elements (7), arranged in a first rolling element cage (8);

c) a running rail (2) that is movably held on the middle rail (3) via a plurality of second rolling elements (5), arranged in a second rolling element cage (6), and movable along a an upper track of the middle rail (3), wherein d) an opening is provided on the middle rail (3) within the track and accommodates a support element (10), which supports the running rail (2) on the guide rail (4) in a retracted position of the pullout guide (1), the opening having a rectangular shape bounded by the track on a first longitudinal side, a second longitudinal side, a rear side and a front side, and e) the support element (10) is mounted on the middle rail (3) so that the support element can be lowered so as to not protrude above the middle rail (3), wherein at least one said second rolling element (5) is configured to pass over the opening for the support element (10) when the support element is lowered, wherein the second rolling elements (5) are formed longer in a horizontal direction perpendicular to the longitudinal direction of the middle rail (3) than the opening (11) for the support element (10) such that the at least one second rolling element (5) contacts the middle rail on both the first and second longitudinal sides of the opening within the upper track during passing over the opening, wherein the support element (10) is movable from a raised position in the retracted position of the pullout guide (1) to a lowered position in an extended position of the pullout guide (1), wherein in the raised position the support element (10) extends through the opening (11) in the middle rail (3) and in the lowered position an upper surface of the support element (10) does not protrude beyond the upper track (30) of the middle rail (3), wherein the guide rail (4) has an approach slope (41) that is configured for raising or lowering the support element (10), wherein a bearing block (13) is fixed to the middle rail (3) and supports the support element (10) in a lowerable and movable manner, wherein the running rail (2) has a downwardly projecting embossing (21) which, in the retracted position, rests on the support element (10), wherein the support element (10) is designed as a rotatably mounted support roller, and wherein the middle rail is formed on a horizontally aligned web, wherein the second rolling elements are at least partially movable over the opening through which the support roller passes in the raised position, so that in the extended position of the pullout guide, the second rolling elements are arranged at least partially over the opening.

2. The pullout guide according to claim 1, wherein the bearing block (13) has two slots (14) or elongated receptacles in which pins (12) projecting laterally from the support element (10) engage.

3. The pullout guide according to claim 1, wherein the bearing block (13) is fixed to the middle rail (3) in a clamping or latching manner or is integrally formed with the middle rail.

4. The pullout guide according to claim 1, wherein the bearing block (13) is arranged at a distance from the upper track (30) of the middle rail (3) in a spatial direction.

5. The pullout guide according to claim 1, wherein the embossing (21) is formed in a shape of a strip in the longitudinal direction of the running rail (2) and has an approach slope (22).

6. The pullout guide according to claim 1, wherein in the extended position of the pullout guide, at least one of the second rolling elements extend beyond an end of the middle rail.

* * * * *